US010138668B1

(12) United States Patent
Lin

(10) Patent No.: US 10,138,668 B1
(45) Date of Patent: Nov. 27, 2018

(54) POSITION ADJUSTMENT APPARATUS

(71) Applicant: Hung Chin Architectural Hardware Co., New Taipei (TW)

(72) Inventor: Wei Chun Lin, New Taipei (TW)

(73) Assignee: HUNG CHIN ARCHITECTURAL HARDWARE CO., New Taipei (TW)

( * ) Notice: Subject to any disclaimer, the term of this patent is extended or adjusted under 35 U.S.C. 154(b) by 0 days.

(21) Appl. No.: 15/604,682

(22) Filed: May 25, 2017

(51) Int. Cl.
*E05F 5/12* (2006.01)

(52) U.S. Cl.
CPC ..... *E05F 5/12* (2013.01); *E05Y 2900/132* (2013.01)

(58) Field of Classification Search
CPC ..... E05F 5/12; E05Y 2900/132
USPC ..... 49/103
See application file for complete search history.

(56) References Cited

U.S. PATENT DOCUMENTS 1,338,027 A * 4/1920 Lindberg ..... E05F 17/004 292/DIG. 12
1,579,751 A * 4/1926 Bickley ..... E05F 17/004 292/DIG. 12
1,824,109 A * 9/1931 Allard ..... E05F 17/004 49/103
2,153,693 A * 4/1939 Mitchell ..... E05F 17/004 49/103
5,944,399 A * 8/1999 Gillispie ..... E05F 1/006 312/324
6,742,302 B2 * 6/2004 Karkkainen ..... E05F 5/12 49/103
2001/0015032 A1 * 8/2001 Juntunen ..... E05F 5/12 49/103
2001/0025450 A1 * 10/2001 Juntunen ..... E05F 5/12 49/103
2013/0200767 A1 * 8/2013 Mueller ..... A47B 81/00 312/295
2014/0259933 A1 * 9/2014 Tyler ..... E05F 5/12 49/103
2017/0183898 A1 * 6/2017 Soderqvist ..... E05F 5/12

* cited by examiner

*Primary Examiner* — Gregory J Strimbu
(74) *Attorney, Agent, or Firm* — Amin, Turocy & Watson LLP

(57) ABSTRACT

A position adjustment apparatus includes a housing main body, a connecting shaft, a spring, a guiding shaft and a rear shaft. The connecting shaft and the spring are installed between the guiding shaft and the rear shaft, and the spring is configured to be a compression spring; therefore, the structure of the position adjustment apparatus is simplified, manufacturing costs are reduced, and the assembly and manufacturing speed of the apparatus are increased along with the use of the compression spring to reduce the destruction of the spring structure due to pulling thereon. Consequently, as the guiding shaft drives the connecting shaft to actuate the rear shaft, the objective of prolonging the useful lifetime of the position adjustment apparatus can be achieved without the use of any torsion springs or pull springs.

3 Claims, 7 Drawing Sheets

POSITION ADJUSTMENT APPARATUS

(a) TECHNICAL FIELD OF THE INVENTION

The present invention is related to a position adjustment apparatus for controlling a closing sequence of a double-door, in particular, to a position adjustment apparatus capable of achieving simplified structure, reduced manufacturing cost and increased assembly and manufacturing speed while prolonging the useful lifetime thereof.

(b) DESCRIPTION OF THE PRIOR ART

Double-doors are commonly installed in buildings, and positioners or position adjusters are used to control the closing sequence of the double-doors. Typically, a protruding plate capable of hindering visions is installed at the edge of one of the doors and between the gap between the two doors in order to prevent people outside the double-door from viewing or peeping the internal of the double-door via the door gap. In addition, Taiwanese Patent No. 390385 discloses "Position Adjustment Apparatus for Double-Door" describes the aforementioned condition in FIG. 1 and FIG. 2 of the content of the specification. Accordingly, it is necessary to utilize a positioner or a position adjuster in order to successfully close such type of double-doors along with the achievement of the effect of preventing peeping of the internal of the door.

Furthermore, U.S. Pat. No. 6,250,014 B1 also discloses a "Company Door Coordinator", and in FIG. 3 of the patent also shows that a guiding shaft and a rear shaft are pivotally attached to an elongated cylindrical housing. The portions of the guiding shaft and the rear shaft extended out of the housing are pivotally attached to a roller. In addition, a connecting shaft is pivotally attached between the guiding shaft and the rear shaft inside the housing. The connecting shaft is further pivotally attached to an arresting cam assembly, and the arresting cam assembly moveably abuts against the flange of the guiding shaft. Moreover, with the cooperation of the torsion spring installed at the pin of the guiding shaft, the torsion spring installed on the arresting cam assembly and the torsion spring installed on the rear shaft, linkage movements between the guiding shaft and the rear shaft can be achieved.

In the aforementioned technical solution, it is found that during the usage process of the device utilizing the torsion springs, after a period of time of compression or relaxation, the torsion springs are prone to generate metal fatigue such that the torsions springs can be fractured. Since the operating action of compression and relaxation of torsion spring can have relatively greater destructive forces on the structure of the springs, the useful lifetime of the coordinator (also known as a positioner or a position adjuster) is reduced, and such drawback is most prominent for torsion springs. In addition, in the technical field of positioner, position adjuster or coordinator, a Pull Spring type of design is also known; however, it also exhibits the drawback of relatively short useful lifetime. Similarly, such type of spring is also subject to the action of pulling and stretching, which generates a greater destructive force and reduces the useful lifetime thereof.

In addition, the installation of arresting cam assembly and connecting shaft between the guiding shaft and the rear shaft not only complicates the overall structure but also affects the production speed of manufacturing process, and drawbacks exist in such device. Accordingly, there is a need for an improvement over the aforementioned drawbacks, and the inventor seeks to overcome such drawbacks with unique and reasonable designs.

SUMMARY OF THE INVENTION

In view of the drawbacks of prior arts, an objective of the present invention is to develop a position adjustment apparatus capable of achieving simplified structure, reduced manufacturing cost and facilitated construction technique and speed while improving the useful lifetime thereof.

To achieve the aforementioned objectives, the present invention provides a position adjustment apparatus, comprising: a housing main body having an upper end surface, a lower end surface, a front end surface and a rear end surface formed thereon respectively; the front end surface having a first opening and a second opening formed thereon respectively; the first opening and the second opening penetrating into an internal of the housing main body respectively; a separation hole formed between the first opening and the second opening; a fifth through hole and a sixth through hole respectively formed on the upper end surface and the lower end surface of the second opening and penetrating therethrough; and circumferential edges of the fifth through hole and the six through hole having a first limiting portion and a second limiting portion formed thereon respectively; a connecting shaft arranged at the internal of the housing main body; the connecting shaft having one end formed of a first pivotal attachment hole at one end and a second pivotal attachment hole formed at another end thereof; the connecting shaft having a first retaining portion and a second retaining portion formed thereon, and a spring moveably attached on the connecting shaft and arranged between the first retaining portion and the second retaining portion; a guiding shaft having one end pivotally attached to a first roller and another end pivotally attached onto the internal of the housing main body at a location of the second opening and the second pivotal attachment hole respectively; and a rear shaft having one end pivotally attached onto a second roller and another end pivotally attached onto the internal of the housing main body at a location of the first opening and the first pivotal attachment respectively.

According an embodiment of the position adjustment apparatus of the present invention, wherein the spring is a compression spring. In addition, the pivotally attachment of the another end of the guiding shaft onto the internal of the housing main body is accomplished by providing a third through hole and a fourth through hole formed to directly penetrate through the upper end surface and the lower end surface at a location of the second opening respectively, and using a first pivotal attachment member to penetrate through the another end of the guiding shaft and the third through hole as well as the fourth through hole for pivotal attachment thereon, followed by using a second pivotal attachment member to penetrate through the another end of the guiding shaft and the second pivotal attachment hole for pivotal attachment thereon. Furthermore, the pivotally attachment of the another end of the rear shaft onto the internal of the housing main body is accomplished by providing a first through hole and a second through hole formed to directly penetrate through the upper end surface and the lower end surface at a location of the first opening respectively, and using a third pivotal attachment member to penetrate through the another end of the rear shaft and the first through hole as well as the second through hole for pivotal attachment thereon, followed by using a fourth pivotal attachment member to penetrate through the another end of the rear shaft and the first pivotal attachment hole for pivotal attachment thereon.

Accordingly, the present invention utilizes the connecting shaft and the spring installed between the guiding shaft and the rear shaft while the spring is configured to be a compression spring in order to achieve the advantageous effects of simplified structure, reduced manufacturing cost and increased assembly and manufacturing speed. Furthermore, with the arrangement of the compression spring, the destruction caused by pulling and extension of the spring structure can be reduced such that the guiding shaft is able to drive the connecting shaft to further actuate the rear shaft while achieving the objective of prolonging the useful lifetime of the position adjustment apparatus. Consequently, advantageous effects of the present invention can be achieved without the use of undesirable torsion springs or pull springs.

DETAILED DESCRIPTION OF THE PREFERRED EMBODIMENTS

Figure 1:
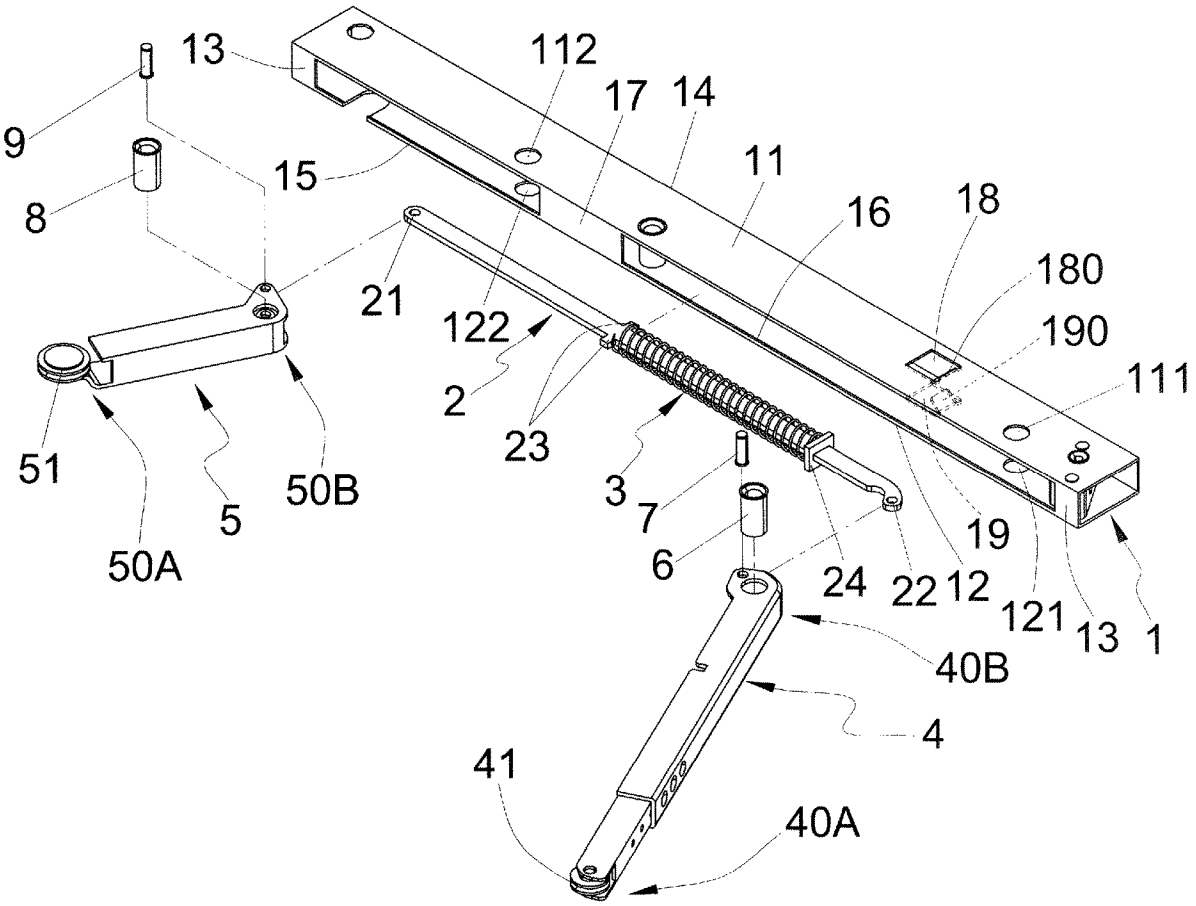
FIG. 1 is a perspective exploded view of the position adjustment apparatus according to a preferred embodiment of the present invention.
Figure 2:
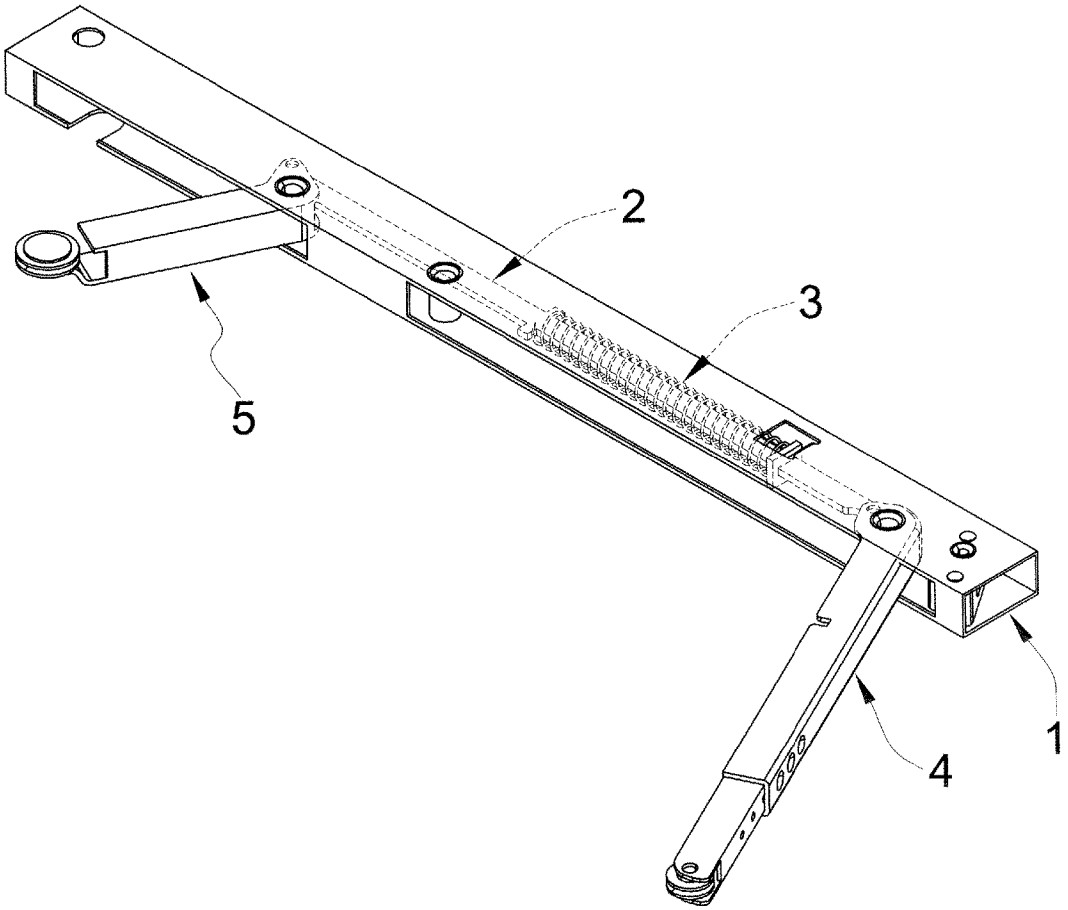
FIG. 2 is a perspective assembly view of the preferred embodiment of the present invention as shown in FIG. 1.

As shown in FIG. 1 and FIG. 2, the present invention provides a position adjustment apparatus, comprising a housing main body 1, a connecting shaft 2, a guiding shaft 4 and a rear shaft 5.

The housing main body 1 includes an upper end surface 11, a rear end surface 12, a front end surface 13 and a rear end surface 14. Accordingly, in this embodiment, the housing main body 1 is of a cubic shape, and the front end surface 13 includes a first opening 15 and a second opening 16. The first opening 15 and the second opening 16 penetrate into the internal of the housing main body 1 respectively, and a separation portion 17 is formed between the first opening 15 and the second opening 16. In addition, the upper end surface 11 and the lower end surface 12 at the location of the second opening 16 are respectively formed of a fifth through hole 18 and a sixth through hole 19 thereon and penetrating therethrough. The circumferential edges of the fifth through hole 18 and the six through hole 19 include a first limiting portion 180 and a second limiting portion 190 formed thereon respectively. Furthermore, the first limiting portion 180 and the second limiting portion 190 are formed to indent inward toward the internal of the housing main body 1.

The connecting shaft 2 is arranged at the internal of the housing main body 1. The connecting shaft 2 includes one end formed of a first pivotal attachment hole 21 and a second pivotal attachment hole 22 formed at another end thereof. The portion of the connecting shaft 2 where the second pivotal attachment hole 22 is located is slightly bent. The connecting shaft 2 includes a first retaining portion 23 and a second retaining portion 24 formed thereon. In this embodiment, the second retaining portion 24 is moveably mounted onto the connecting shaft 2; however, the present invention is not limited to such configuration only. In addition, a spring 3 is moveably attached on the connecting shaft 2 and arranged between the first retaining portion 23 and the second retaining portion 24. Based on the arrangement distance provided between the first retaining portion 23 and the second retaining portion 24, the spring can be configured to be a compression spring with resilient elasticity.

Furthermore, the guiding shaft 4 includes one end 40A pivotally attached to a first roller 41 and another end 40B pivotally attached onto the internal of the housing main body 1 at a location of the second opening 16 and the second pivotal attachment hole 22 respectively. In this embodiment, the pivotally attachment of the another end 40B of the guiding shaft 4 onto the internal of the housing main body 1 is accomplished by providing a third through hole 111 and a fourth through hole 121 formed to directly penetrate through the upper end surface 11 and the lower end surface 12 at a location of the second opening 16 respectively, and a first pivotal attachment member 6 is used to penetrate through the another end 40B of the guiding shaft 4 and the third through hole 111 as well as the fourth through hole 121 for pivotal attachment thereon, followed by using a second pivotal attachment member 7 to penetrate through the another end 40B of the guiding shaft 4 and the second pivotal attachment hole 22 for pivotal attachment thereon. Moreover, the first pivotal attachment member 6 and the second pivotal attachment member 7 are arranged at alternate locations with each other on the another end 40B of the guiding shaft 4 in order to for a rotational torque.

In addition, under the same or similar concept, a rear shaft 5 includes one end 50A pivotally attached onto a second roller 51 and another end 50B pivotally attached onto the internal of the housing main body 1 at a location of the first opening 15 and the first pivotal attachment 21 respectively. In this embodiment, the pivotally attachment of the another end 50B of the rear shaft 5 onto the internal of the housing main body 1 is accomplished by providing a first through hole 112 and a second through hole 122 formed to directly penetrate through the upper end surface 11 and the lower end surface 12 at a location of the first opening 15 respectively, and a third pivotal attachment member 8 is used to penetrate through the another end 50B of the rear shaft 5 and the first through hole 112 as well as the second through hole 122 for pivotal attachment thereon, followed by using a fourth pivotal attachment member 9 to penetrate through the another end 50B of the rear shaft 5 and the first pivotal attachment hole 21 for pivotal attachment thereon. Moreover, the third pivotal attachment member 8 and the fourth pivotal attachment member 9 are arranged at alternate locations with each other on the another end 50B of the rear shaft 5 in order to for a rotational torque.

Figure 3:
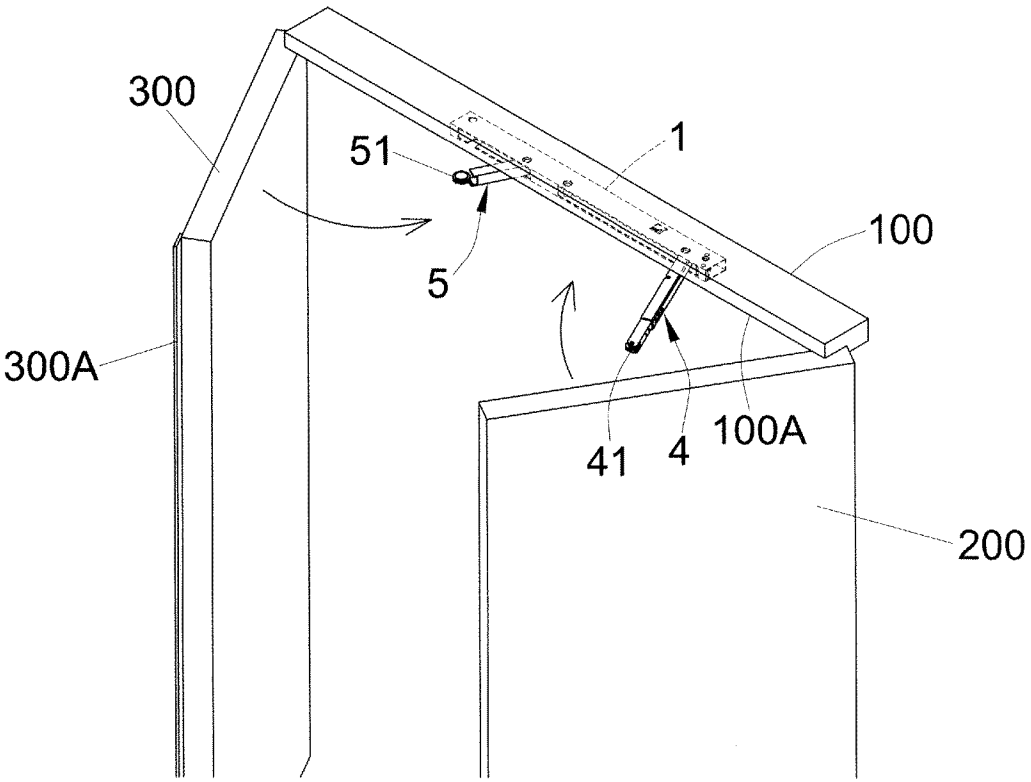
FIG. 3 is a perspective view showing the position adjustment apparatus according to a preferred embodiment of the present invention installed at a lower edge of a door frame.
Figure 4:
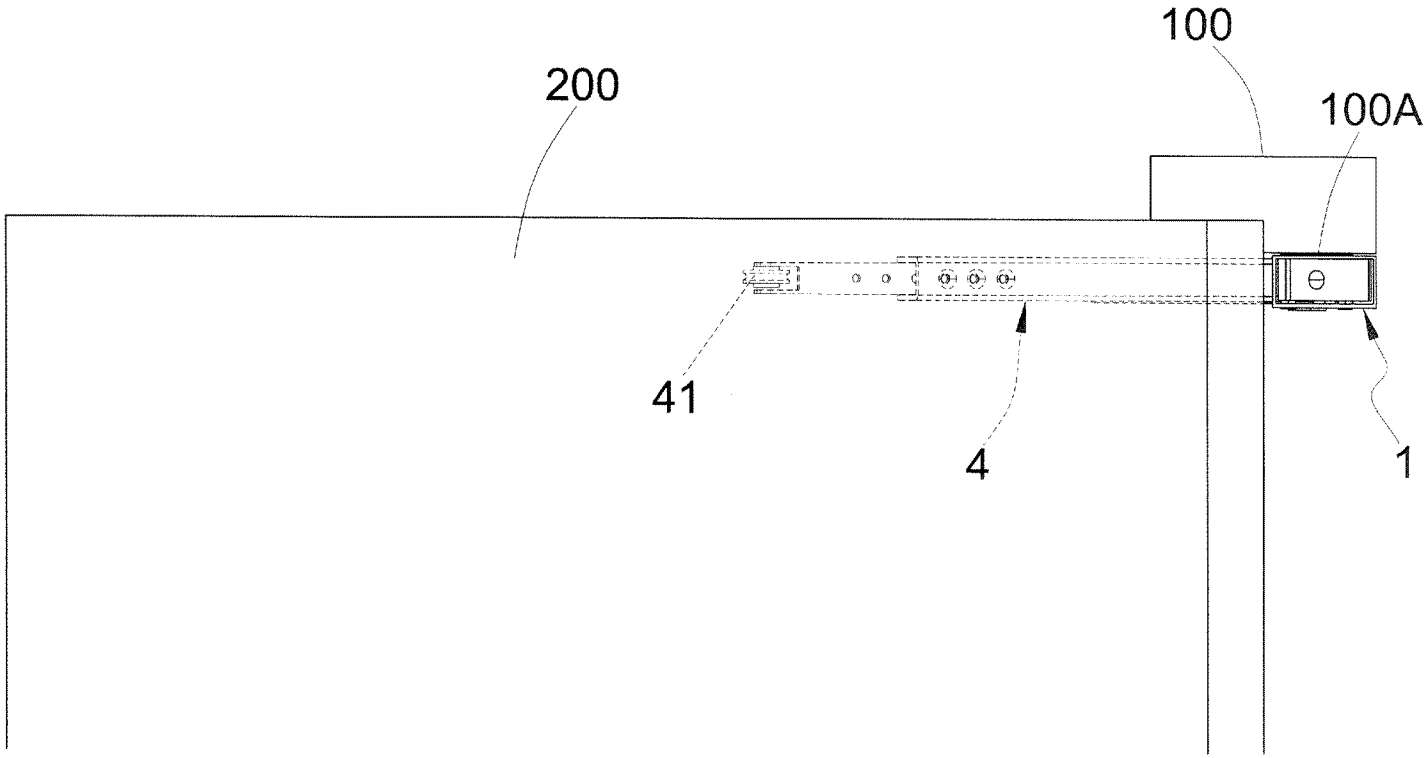
FIG. 4 is a side view showing the position adjustment apparatus according to a preferred embodiment of the present invention installed at a lower edge of a door flame.

Accordingly, as shown in FIG. 3 and FIG. 4, the position adjustment apparatus of the present invention is applicable to an entrance using a double-door comprising a first door 200 and a second door 300. To prevent the vision blocking plate 300A installed at the edge of the second door 300 with a door gap from jamming with the first door 200 during the closing of the doors, the housing main body 1 can be installed at the lower edge 100A of the door frame 100. In addition, the guiding shaft 4 and the rear shaft 5 can be driven by the closing actions of the first door 200 and the second door 300 in such a way that the first door 200 and the second door 300 are temporarily retained at the first roller 41 and the second roller 51 respectively, following which the guiding shaft 4 and the rear shaft 5 can then have actions.

Figure 5:
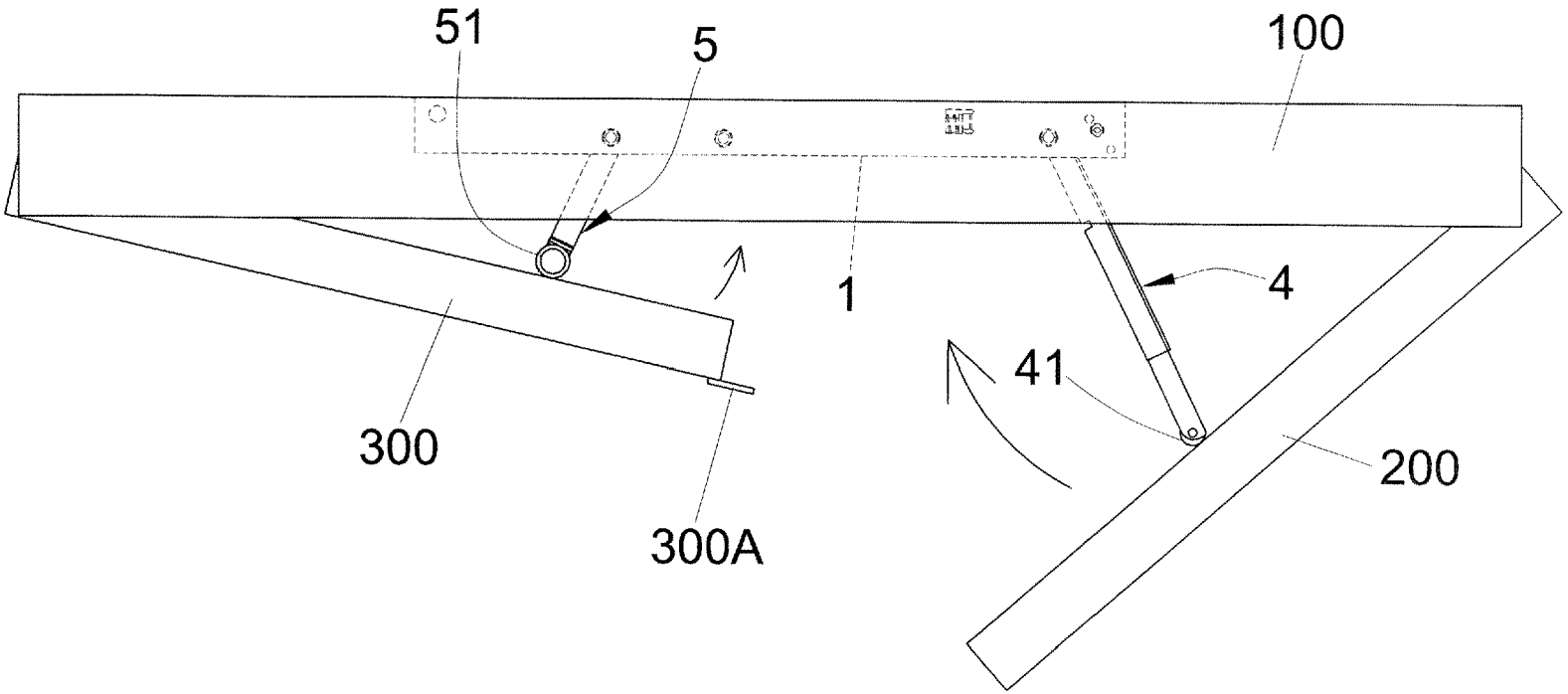
FIG. 5 shows a schematic view of the actions of the position adjustment apparatus of a preferred embodiment of the present invention is installed at a lower edge of a door frame, following which the two doors are restricted by the guiding shaft and the rear shaft and are able to be closed in a predefined sequence.
Figure 6:
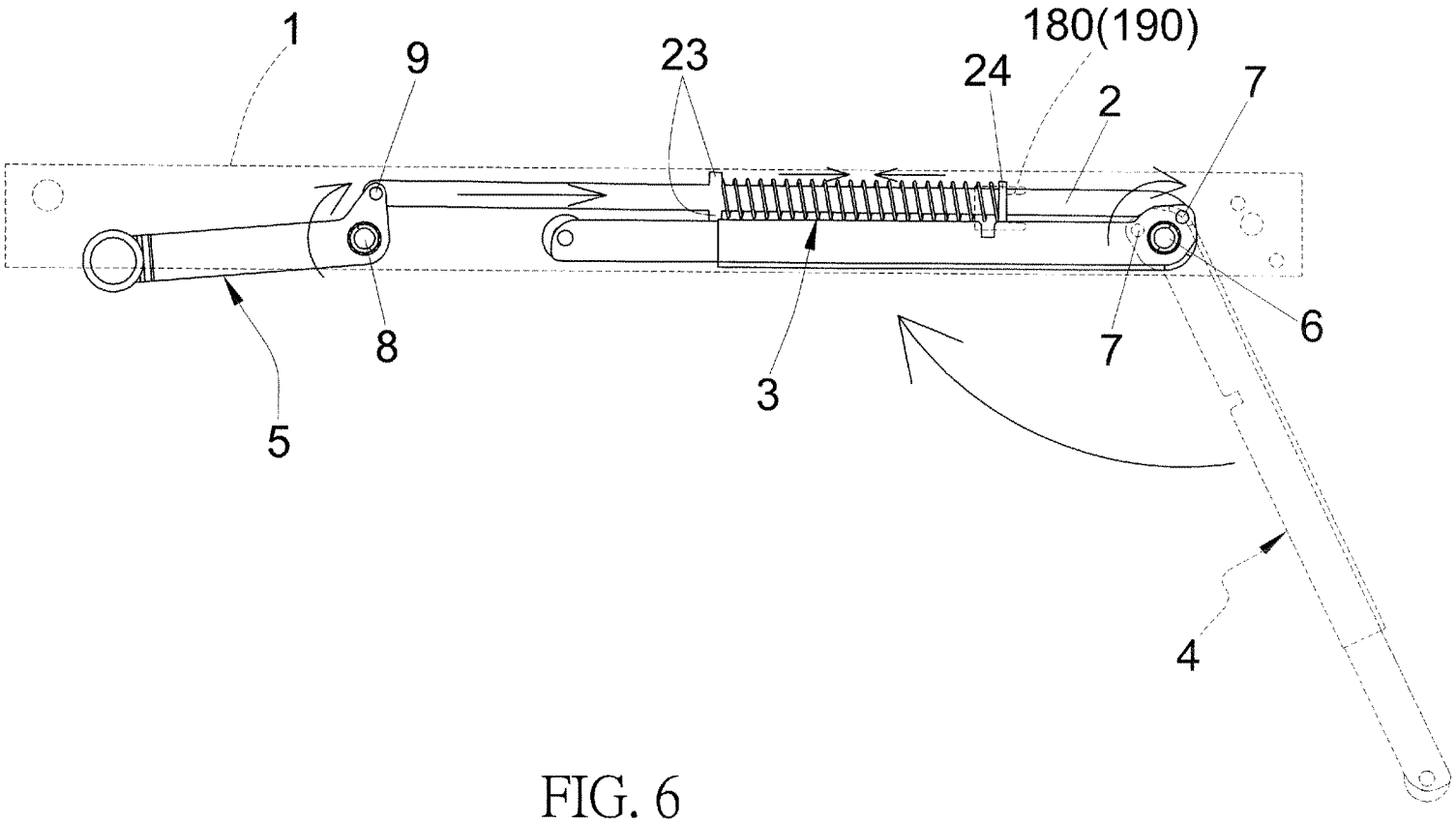
FIG. 6 shows a schematic view of the actions of the position adjustment apparatus according to preferred embodiment of the present invention as shown in FIG. 5, in which the guiding shaft is restricted by the first door to perform action, and the rear shaft is driven by the operation of the guiding shaft.
Figure 7:
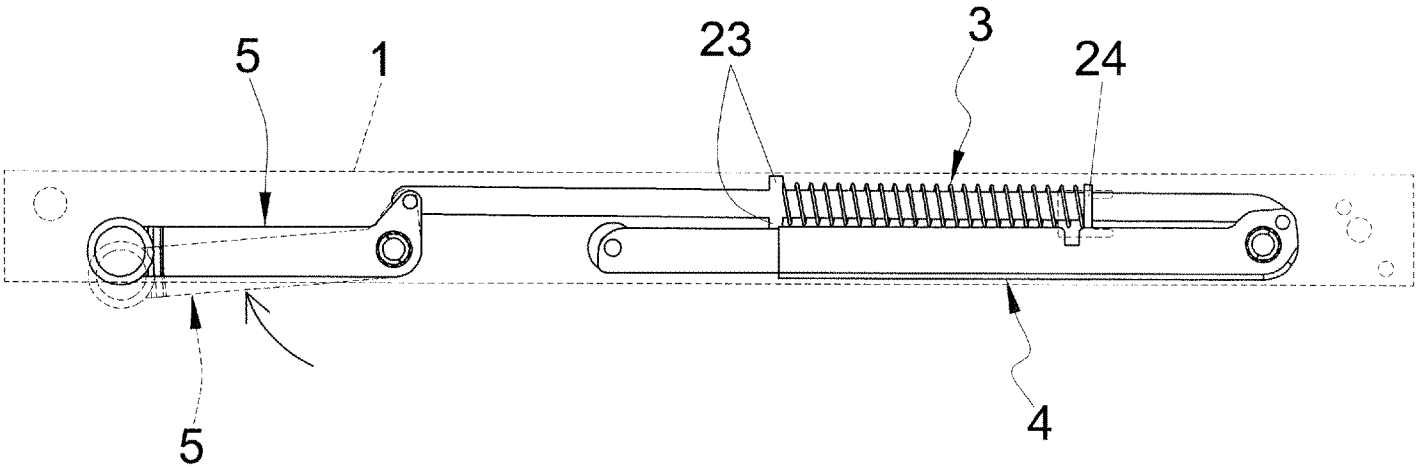
FIG. 7 shows a schematic view of the actions of the guiding shaft and the rear shaft a preferred embodiment of the present invention after the two doors are closed.

Moreover, please refer to FIG. 5 and FIG. 6. When a user pushes the first door 200 and the second door 300 at the same time and when a returning device (not shown in the drawings, but not limited to such device only) is used to allow the first door 200 and the second door 300 to return to the closing position, during the time when the first door 200 and the second door 300 are nearly simultaneously retained on the first roller 41 and the second roller 51 respectively, then with the closing force of the first door 200, the guiding shaft 4 is pushed toward the housing main body 1 in a clockwise direction, and the alternate arrangement of the first pivotal attachment member 6 and the second pivotal attachment member 7 is able to form the rotation of the torque in the clockwise direction simultaneously in order to drive the connecting shaft 2. Since the spring 3 is retained by the first retaining portion 23 and the second retaining portion 24 while the second retaining portion 24 is also subject to the limitations imposed by the first limiting portion 180 and the second limiting portion 190, the spring 3 is formed of a compression spring with resilient elasticity. Furthermore, at the same time, the connecting shaft 2 is able to generate the rotation of torque in the clockwise direction based on the alternate arrangement of the third pivotal attachment member 8 and the fourth attachment member 9 such that it is able to drive the rear shaft 5 to be pushed toward the internal of the housing main body 1. Consequently, the sequential closing of the first door 200 and the second door 300 can be achieved while preventing the vision blocking plate 300A from jamming with the first door 200 during the closing of the double-door.

In this embodiment, since the connecting shaft 2 and the spring 3 are installed between the guiding shaft 4 and the rear shaft 5, and since the spring 3 is configured to be a compression spring, the present invention is able to achieve the advantageous effects of simplified structure, reduced manufacturing cost and the increased assembly and manufacturing speed due to the simplified structure. In addition, with the arrangement of the compression spring, the destruction of the structure of the spring 3 due to pulling and extension (preventing rupture generated due to outward pulling; in case where the spring 3 ruptures, the position adjustment apparatus would then lose its operation function) can be reduced; therefore, when the guiding shaft 4 drives the connecting shaft 2 in order to actuate the rear shaft, the objective of prolonging the useful lifetime of the position adjustment apparatus can be achieved, and advantageous effects can be achieved without the use of known torsion spring or pull spring. The aforementioned direction of clockwise is to describe the direction shown in the drawings only, and the present invention is not limited to such direction only.

Finally, after the first door 200 and the second door 300 of the double-door are closed (as shown in FIG. 4), the guiding shaft 4 and the rear shaft 5 can be completely retracted into the internal of the housing main body 1. On the other hand, when the first door 200 and the second door 300 are opened again, due to the resilient force of the spring 3 after compression, the guiding shaft 4 and the rear shaft 5 can extend out of the housing main body 1 such that they can be repetitively used.

I claim:

1. A position adjustment apparatus, comprising:

a housing main body having an upper end surface, a lower end surface, a front end surface and a rear end surface; the housing main body having a first opening and a second opening formed in the front end surface; a separation portion formed between the first opening and the second opening; a fifth through hole and a sixth through hole respectively formed in the upper end surface and the lower end surface and communicating with the second opening; and circumferential edges of the fifth through hole and the sixth through hole having a first limiting portion and a second limiting portion respectively formed thereon;

a connecting shaft arranged inside the housing main body; the connecting shaft having one end formed with a first pivotal attachment hole and another end formed with a second pivotal attachment hole; the connecting shaft having a first retaining portion and a second retaining portion formed thereon, and a spring moveably disposed around an outer surface of the connecting shaft, and arranged between the first retaining portion and the second retaining portion, wherein the spring is a compression spring;

a guiding shaft having one end pivotally attached to a first roller and another end pivotally disposed in the second opening of the housing main body and attached to the second pivotal attachment hole of the connecting shaft; and a rear shaft having one end pivotally attached to a second roller and another end pivotally disposed in the first opening of the housing main body and attached to the first pivotal attachment hole of the connecting shaft.

2. The position adjustment apparatus according to claim 1, wherein the housing main body includes third and fourth through holes adjacent the second opening and extending through the upper end surface and the lower end surface, respectively, for pivotally attaching the another end of the guiding shaft to the housing main body by using a first pivotal attachment member extending through the another end of the guiding shaft and the third and fourth through holes, and a second pivotal attachment member extending through the another end of the guiding shaft and the second pivotal attachment hole for pivotal attachment of the connecting shaft to the guiding shaft.

3. The position adjustment apparatus according to claim 1, wherein the housing main body includes first and second through holes adjacent the first opening and extending through the upper end surface and the lower end surface, respectively, for pivotally attaching the another end of the rear shaft to the housing main body by using a third pivotal attachment member extending through the another end of the rear shaft and the first and second through holes, and a fourth pivotal attachment member extending through the another end of the rear shaft and the first pivotal attachment hole for pivotally attaching the connecting shaft to the rear shaft.

* * * * *